US011615910B2

(12) United States Patent
Yen et al.

(10) Patent No.: US 11,615,910 B2
(45) Date of Patent: Mar. 28, 2023

(54) TRANSFORMER STRUCTURE

(71) Applicant: Realtek Semiconductor Corporation, Hsinchu (TW)

(72) Inventors: Hsiao-Tsung Yen, Hsinchu (TW); Yuh-Sheng Jean, Hsinchu County (TW); Ta-Hsun Yeh, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 544 days.

(21) Appl. No.: 16/157,456

(22) Filed: Oct. 11, 2018

(65) Prior Publication Data

US 2019/0237238 A1 Aug. 1, 2019

(30) Foreign Application Priority Data

Jan. 29, 2018 (TW) ..... 107103121

(51) Int. Cl.
*H01F 5/00* (2006.01)
*H01F 27/28* (2006.01)
*H01F 19/04* (2006.01)

(52) U.S. Cl.
CPC ..... *H01F 27/2804* (2013.01); *H01F 19/04* (2013.01); *H01F 2027/2809* (2013.01)

(58) Field of Classification Search
CPC ..... H01F 2027/2809
USPC ..... 336/200
See application file for complete search history.

(56) References Cited

U.S. PATENT DOCUMENTS

| | | | | |
|---|---|---|---|---|
| 9,748,033 | B2 | 8/2017 | Yen et al. | |
| 9,793,039 | B1 * | 10/2017 | Abu Qahouq | C01B 32/16 |
| 2009/0039977 | A1 * | 2/2009 | Lee | H03H 7/42 333/25 |
| 2010/0060402 | A1 * | 3/2010 | Chen | H03H 7/422 336/200 |
| 2016/0126002 | A1 * | 5/2016 | Chien | H04B 5/00 320/108 |

FOREIGN PATENT DOCUMENTS

| | | |
|---|---|---|
| CN | 101388277 A | 3/2009 |
| CN | 104037158 A | 9/2014 |

* cited by examiner

*Primary Examiner* — Ronald Hinson
(74) *Attorney, Agent, or Firm* — Locke Lord LLP; Tim Tingkang Xia, Esq.

(57) ABSTRACT

A transformer structure includes a first inductor and a second inductor. The first inductor has first turns. The second inductor has second turns. The first inductor and the second inductor are disposed in an interlaced manner. Except jump wires, the first and the second inductors are substantially disposed on a first layer. At least one of the first turns is substantially disposed between another first turn and one of the second turns.

17 Claims, 5 Drawing Sheets

TRANSFORMER STRUCTURE

CROSS-REFERENCE TO RELATED APPLICATION

This application claims priority to Taiwan Application Serial Number 107103121, filed on Jan. 29, 2018, which is herein incorporated by reference.

BACKGROUND

Technical Field

Present disclosure relates to an inductor structure. More particularly, the present disclosure relates to a transformer structure formed by inductor structures.

Description of Related Art

Nowadays, inductor apparatuses are essential in an integrated circuit, as well as the transformer structure formed by inductors. However, a satisfactory to higher inductance usually brings about the decrease of the coupling coefficient and the quality factor.

DETAILED DESCRIPTION

Figure 1:
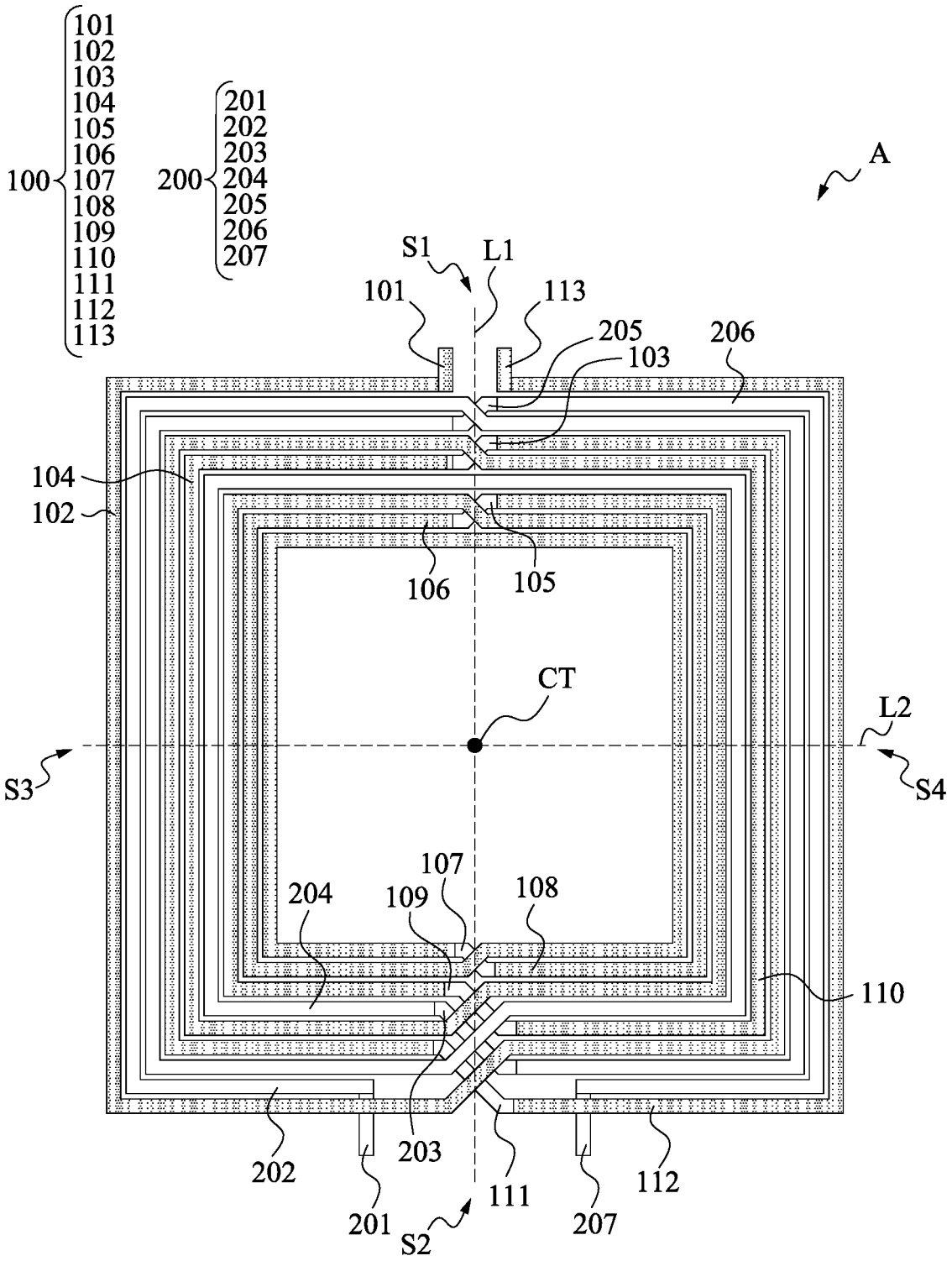
FIG. 1 is a schematic diagram of a transformer structure according to an embodiment of present disclosure.

FIG. 1 is a schematic diagram showing an above view of a transformer structure according to an embodiment of present disclosure. In the embodiment, the transformer structure is disposed in a first area A. A first imaginary line L1 crosses a second imaginary line L2 at a central point CT of the first area A. As shown in the figure, the first area A is demarcated by the first imaginary line L1, as a first side S1 and a second side S2. The first area A is demarcated by the second imaginary line L2, as a third side S3 and a fourth side S4.

As shown in FIG. 1, in the embodiment, the first area A has nine laps, which are first to ninth laps, counted in an outer-inner manner. A first inductor 100 and a second inductor 200 are disposed on the nine laps of the first area A in an interlaced manner. The first inductor 100 includes six turns disposed on the first, the fourth, the fifth, the seventh, the eighth and the ninth laps of the first area A. The second inductor 200 includes three turns disposed on the second, the third and the sixth laps of the first area A. Three of turns of the first inductor, which are disposed on the fourth, the fifth and the seventh laps of the first area A, are adjacent to another turn of the first inductor 100 and a turn of the second inductor 200. Two of turns of the second inductor, which are disposed on the second and the third laps of the first area A, are adjacent to another turn of the second inductor 200 and a turn of the first inductor 100.

As shown in FIG. 1, in the embodiment, a first port 101 of the first inductor 100 is coupled to a metallic segment 102 at the first side S1. The metallic segment 102 is substantially disposed on the first lap and the fourth lap of the first area A. Along the first lap of the first area A, the metallic segment 102 winds from the first side S1 to the third side S3, then to the second side S2 in a counterclockwise manner. At the second side S2, the metallic segment 102 routes to the fourth lap of the first area A. Along the fourth lap of the first area A, the metallic segment 102 is wound from the second side S2 to the fourth side S4, then to the first side S1. At the first side 81, a metallic segment 103 is disposed to couple the metallic segment 102 with a metallic segment 104 that is disposed on the fifth lap of the first area A. Along the fifth lap of the first area A, the metallic segment 104 winds from the first side S1 to the third side S3, then to the second side S2. At the second side S2, the metallic segment 104 routes to the seventh lap of the first area A. Along the seventh lap of the first area A, the metallic segment 104 winds from the second side S2 to the fourth side S4, then to the first side S1. At the first side S1, a metallic segment 105 is disposed to couple the metallic segment 104 with a metallic segment 106 that is disposed on the eighth lap of the first area A. Along the eighth lap of the first area A, the metallic segment 106 winds from the first side S1 to the third side S3, then to the second side S2. At the second side S2, the metallic segment 106 routes to the ninth lap of the first area A. Along the ninth lap of the first area A, the metallic segment 106 forms a turn centered by the central point CT in a counterclockwise manner.

In the embodiment, at the second side S2, a metallic segment 107 is disposed to couple the metallic segment 106 with a metallic segment 108 that is disposed on the eighth lap of the first area A. Along the eighth lap of the first area A, the metallic segment 108 winds from the second side S2 to the fourth side S4, then to the first side S1. At the first side S1, the metallic segment 108 routes to the seventh lap of the first area A. Along the seventh lap of the first area A, the metallic segment 108 winds from the first side S1 to the third side S3, then to the second side S2. At the second side S2, a metallic segment 109 is disposed to couple the metallic segment 108 with a metallic segment 110 that is disposed on the fifth lap of the first area A. Along the fifth lap of the first area A, the metallic segment 110 winds from the second side S2 to the fourth side S4, then to the first side S1. The metallic segment 110 is routed to the fourth lap of the first area A at the first side S1. Along the fourth lap of the first area A, the metallic segment 110 winds from the first side S1 to the third side S3, then to the second side S2. At the second side S2, a metallic segment 111 is disposed to couple the metallic segment 110 with a metallic segment 112 that is disposed on the first lap of the first area. Along the first lap of the first area A, the metallic segment 112 winds from the second side S2 to the fourth side S4, then to the first side S1. The metallic segment 112 is coupled to a second port 113 at the first side S1.

In the embodiment, the first inductor 100 includes the first port 101, the metallic segments 102-112 and the second port 113. The metallic segments 103, 105, 107, 109 and 111 are disposed on a first layer. The other metallic segments of the first inductor 100 are disposed on a second layer different from the first layer. In order to bridge the first inductor 100, the metallic segments 103, 105, 107, 109 and 111, connect the other metallic segments in an interlaced manner. The first port 101 and the second port 113 of the first inductor 100 are disposed on the second layer and at the first side S1 of the first area A.

As shown in FIG. 1, in the embodiment, a third port 201 of the second inductor 200 is coupled to a metallic segment 202 at the second side S2. Along the second lap of the first area A, the metallic segment 202 winds from the second side S2 to the third side S3, then to the first side S1 in a clockwise manner. At the first side S1, the metallic segment 202 routes to the third lap of the first area A. Along the third lap of the first area A, the metallic segment 202 winds from the first side S1 to the fourth side S4, then to the second side S2. At the second side S2, a metallic segment 203 is disposed to couple the metallic segment 202 with a metallic segment 204 that is disposed on the sixth lap of the first area A. Along the sixth lap of the first area A, the metallic segment 204 forms a turn centered by the central point CT in a clockwise manner. At the second side S2, the metallic segment 204 routes to the third lap of the first area A. Along the third lap of the first area A, the metallic segment 204 winds from the second side S2 to the third side S3, then to the first side S1. At the first side S1, a metallic segment 205 is disposed to couple the metallic segment 204 with a metallic segment 206 that is disposed on the second lap of the first area A. Along the second lap of the first area A, the metallic segment 206 winds from the first side S1 to the fourth side S4, then to the second side S2. The metallic segment 206 is coupled to a fourth port 207 at the second side S2.

In the embodiment, the second inductor 200 includes the third port 201, the metallic segments 202-206 and the fourth port 207. The third port 201, the metallic segment 203, the metallic segment 205 and the fourth port 207 are disposed on the first layer. The other metallic segments of the second inductor 200 are disposed on the second layer. In order to bridge the second inductor 200, the other metallic segments are connected by the the metallic segments 203 and 205 in an interlaced manner. The third port 201 and the fourth port 207 of the second inductor 200 are disposed at the second side S2 of the first area A. In the embodiment, except the jump wires (e.g. metallic segments 105, 107, 109, etc.), the metallic segments of the first inductor 100 and the second inductor 200 are all disposed on the same layer of an integrated circuit board.

As shown above, a transformer structure with high inductance is provided. The two inductors of the transformer are closely arranged, bringing the transformer a decent coupling coefficient and a good quality factor. For example, as shown in FIG. 1, the metallic segment 104 is disposed next to the metallic segment 110. No capacitance is generated since the metallic segment 104 and the metallic segment 110 are parts of the same inductor. Besides, the mutual inductance can be generated between the metallic segment 104 and the metallic segment 110, it raises the K value of the first inductor 100, so that the electrical characteristic of the first inductor 100 can be improved. Moreover, in the configuration, the metallic segment 110 is disposed adjacent to the metallic segment 204, which is a part of another inductor. It brings mutual inductances and raises the K value of the second inductor 200. The configuration improves the electrical characteristics of the second inductor 200 as well.

Figure 2:
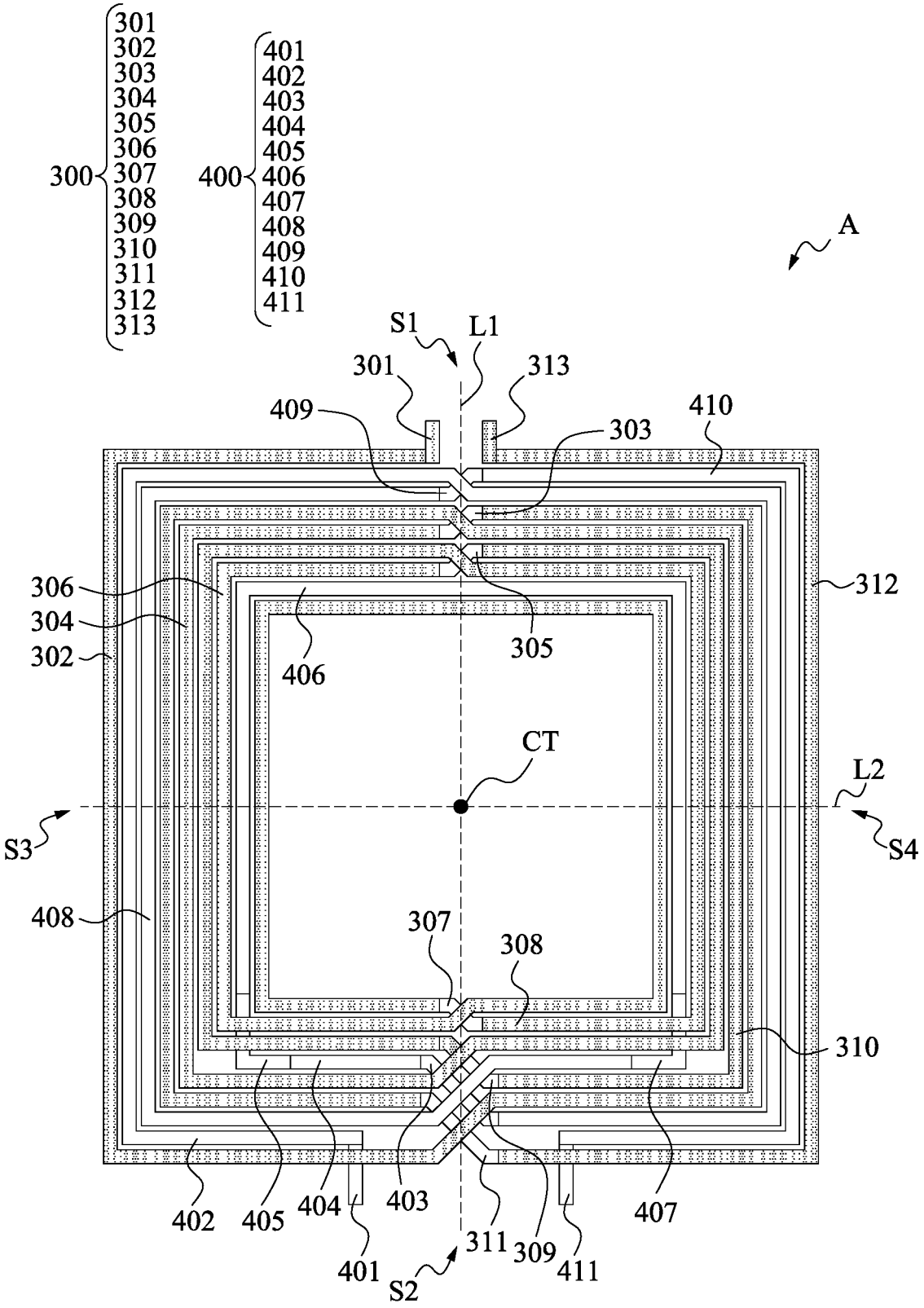
FIG. 2 is a schematic diagram of a transformer structure according to an embodiment of present disclosure.

FIG. 2 is a schematic diagram showing an above view of a transformer structure according to an embodiment of present disclosure. In the embodiment, the transformer structure is disposed in the first area A. It is noted that the illustrations of the imaginary lines L1-L2 and the sides S1-S4 are identical to FIG. 1.

As shown in FIG. 2, in the embodiment, the first area A has nine laps, which are first to ninth laps, counted in an outer-inner manner. A first inductor 300 and a second inductor 400 are disposed on the nine laps of the first area A in an interlaced manner. The first inductor 300 includes six turns disposed on the first, the fourth, the fifth, the sixth, the seventh and the ninth laps of the first area A. The second inductor 400 includes three turns disposed on the second, the third and the eighth laps of the first area A. Five of turns of the first inductor, which are disposed on the fourth, the fifth, the sixth, the seventh and the ninth laps of the first area A, are adjacent to another turn of the first inductor 300 and a turn of the second inductor 400. Two of turns of the second inductor, which are disposed on the second and the third laps of the first area A, are adjacent to another turn of the second inductor 400 and a turn of the first inductor 300. The inductors 300 and 400 are arranged similar to the inductors 100 and 200 in FIG. 1.

In the embodiment, the first inductor 300 includes the first port 301, the metallic segments 302-112 and the second port 313. The metallic segments 303, 305, 307, 309 and 311 are disposed on a first layer. The remaining metallic segments of the first inductor 300 are disposed on a second layer different from the first layer. In order to bridge the first inductor 300, the metallic segments 303, 305, 307, 309 and 311, as shown in FIG. 2, connect the other metallic segments of the first inductor 300 in an interlaced manner. The first port 301 and the second port 313 of the first inductor 300 are disposed on the second layer and at the first side S1 of the first area A. In the embodiment, the second inductor 400 includes the third port 401, the metallic segments 402-410 and the fourth port 411. The third port 401, the metallic segments 403 405, 407 and 409 and the fourth port 411 are disposed on the first layer. In order to bridge the second inductor 400, the metallic segments 403, 405, 407 and 409, as shown in FIG. 2, connect the other metallic segments of the second inductor 400 in an interlaced manner. Moreover, the third port 401 and the fourth port 411 of the second inductor 400 are disposed at the second side S2 of the first area A.

In the embodiment of FIG. 2, the arrangements of the two inductors are different from the embodiment of FIG. 1 in parts. In the embodiment, the metallic segment 402 of the second inductor 400 winds from the second side S2, along the second lap of the first area A, to the third side S3, then to the first side S1 in a counterclockwise manner. At the first side S1, the metallic segment 402 routes to the third lap of the first area A. Along the third lap of the first area A, the metallic segment 402 winds from the first side S1 to the fourth side S4, then to the second side S2. At the second side S2, a metallic segment 403 is disposed to couple the metallic segment 402 with a metallic segment 404 that is disposed on the sixth lap of the first area A. Winding for around one-eighth of a turn, the metallic segment 404 couples to a metallic segment 406 through a metallic segment 405, in which the metallic segment 406 is disposed on the eighth lap of the first area A. Winding for around three-fourth of a turn along the eighth turn of the first area A, the metallic segment 406 couples to one end of a metallic segment 408 through a metallic segment 407, in which the end of the metallic segment 408 is disposed on the sixth lap of the first area A. It other words, when counting from the second side S2, the innermost turn of the second inductor 400 is arranged on the sixth lap of the first area A. And, when counting from the first side S1, the third side S3 or the fourth side S4, the innermost turn of the second inductor 400 is arranged on the eighth lap of the first area A.

Figure 3:
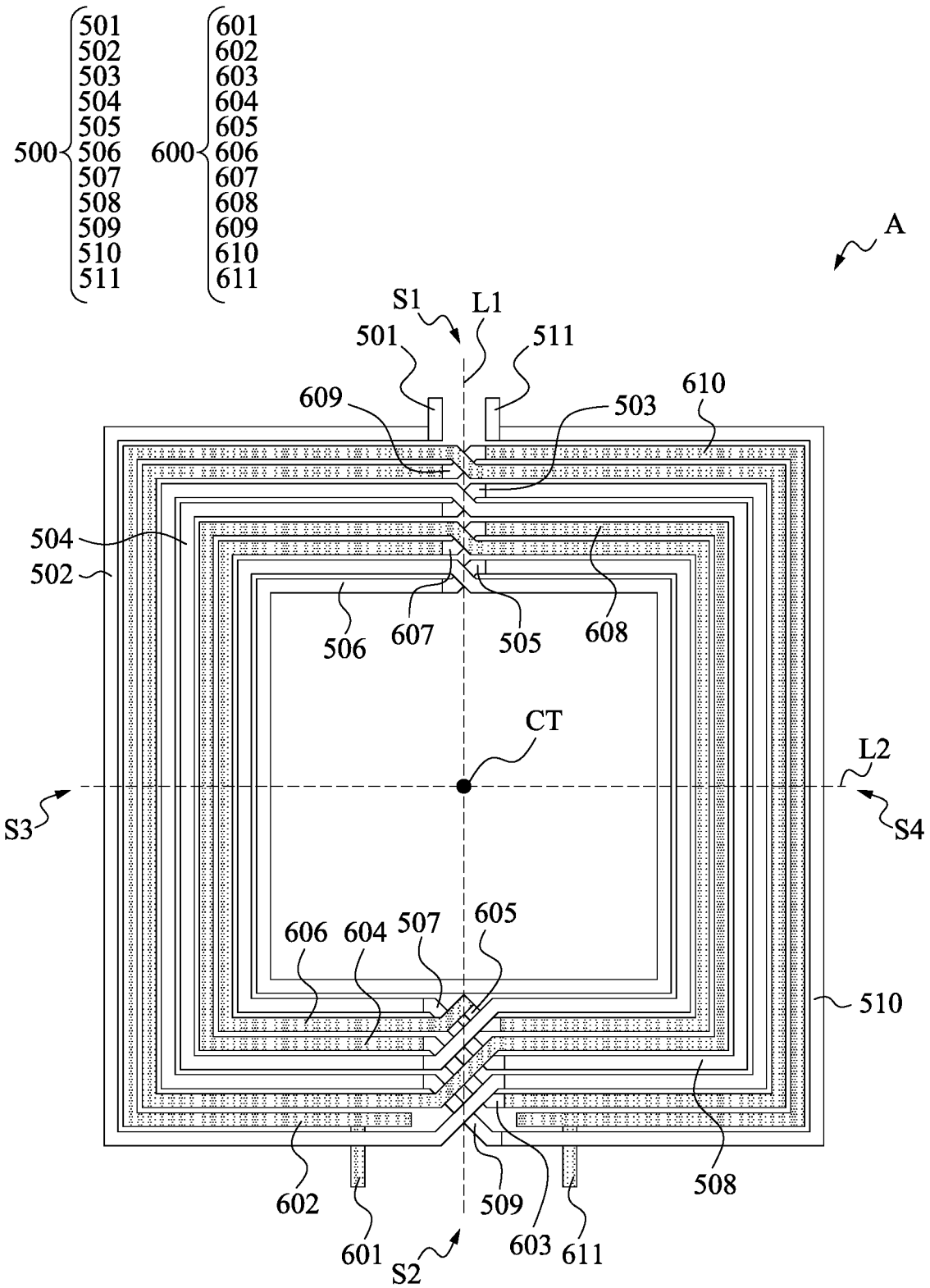
FIG. 3 is a schematic diagram of a transformer structure according to an embodiment of present disclosure.

FIG. 3 is a schematic diagram showing an above view of a transformer structure according to an embodiment of present disclosure. In the embodiment, the transformer structure is disposed in the first area A.

As shown in FIG. 3, in the embodiment, the first area A has nine laps, which are first to ninth laps, counted in an outer-inner manner. A first inductor 500 and a second inductor 600 are disposed on the nine laps of the first area A in an interlaced manner. The first inductor 500 includes five turns disposed on the first, the fourth, the fifth, the eighth and the ninth laps of the first area A. The second inductor 600 includes four turns disposed on the second, the third, the sixth and the seventh laps of the first area A. Three of the first inductor's turns, which are disposed on the fourth, the fifth and the eighth laps of the first area A, are adjacent to another turn of the first inductor 500 and a turn of the second inductor 600. Four of turns of the second inductor, which are disposed on the second, the third, the sixth and the seventh laps of the first area A, are adjacent to another turn of the second inductor 600 and a turn of the first inductor 500. The inductors 500 and 600 are arranged similar to the inductors 100 and 200 in FIG. 1.

In the embodiment, the first inductor 500 includes the first port 501, the metallic segments 502-510 and the second port 511. The metallic segments 503, 505, 507 and 509 are disposed on a first layer. The other metallic segments of the first inductor 500 are disposed on a second layer different from the first layer. In order to bridge the first inductor 500, the metallic segments 503, 505, 507 and 509, as shown in FIG. 3, connect the other metallic segments of the first inductor 500 in an interlaced manner. The first port 501 and the second port 511 of the first inductor 500 are disposed on the second layer and at the first side S1 of the first area A. In the embodiment, the second inductor 600 includes the third port 601, the metallic segments 602-610 and the fourth port 611. The third port 601, the metallic segments 603, 605, 607, and 609 and the fourth port 611 are disposed on the first layer. In order to bridge the second inductor 600, the metallic segments 603, 605, 607 and 609, as shown in FIG. 3, connect the other metallic segments of the second inductor 600 in an interlaced manner. Moreover, the third port 601 and the fourth port 611 of the second inductor 600 are disposed at the second side S2 of the first area A.

Except the numbers of turns that the first inductor 500 and the second inductor 600 have, the arrangements of the inductors 500 and 600 in the embodiment are different from the embodiments of FIG. 1 and FIG. 2 in parts as well. In the embodiment, the metallic segment 604 of the second inductor 600 winds from the second side S2, along the sixth lap of the first area A, to the third side S3, then to the first side S1 in a clockwise manner. At the first side S1, the metallic segment 604 routes to the seventh lap of the first area A. Along the seventh lap of the first area A, the metallic segment 604 winds from the first side S1 to the fourth side S4, then to the second side S2. At the second side S2, a metallic segment 605 is disposed to couple the metallic segment 604 with a metallic segment 606 that is disposed on the eighth lap of the first area A. At the second side S2, the metallic segment 606 routes to the seventh lap of the first area A, then the metallic segment 606 winds along the seventh lap of the first area A. The other metallic segments of the second inductor 600 are arranged as shown in FIG. 3. In other words, the metallic segment 605 of the second inductor 600, as a jump wire being disposed in an available place, effectively connects the metallic segment 604 with the metallic segment 606.

As shown in FIG. 3, in the embodiment, an extension segment is connected to the third port 601 of the second inductor 600 on the first layer, and then the extension segment is coupled to one end of the metallic segment 602 on the second layer. Similarly, an extension segment is connected to the fourth port 611 of the second inductor 600 on the first layer, and then the extension segment is coupled to one end of the metallic segment 610 on the second layer.

Figure 4:
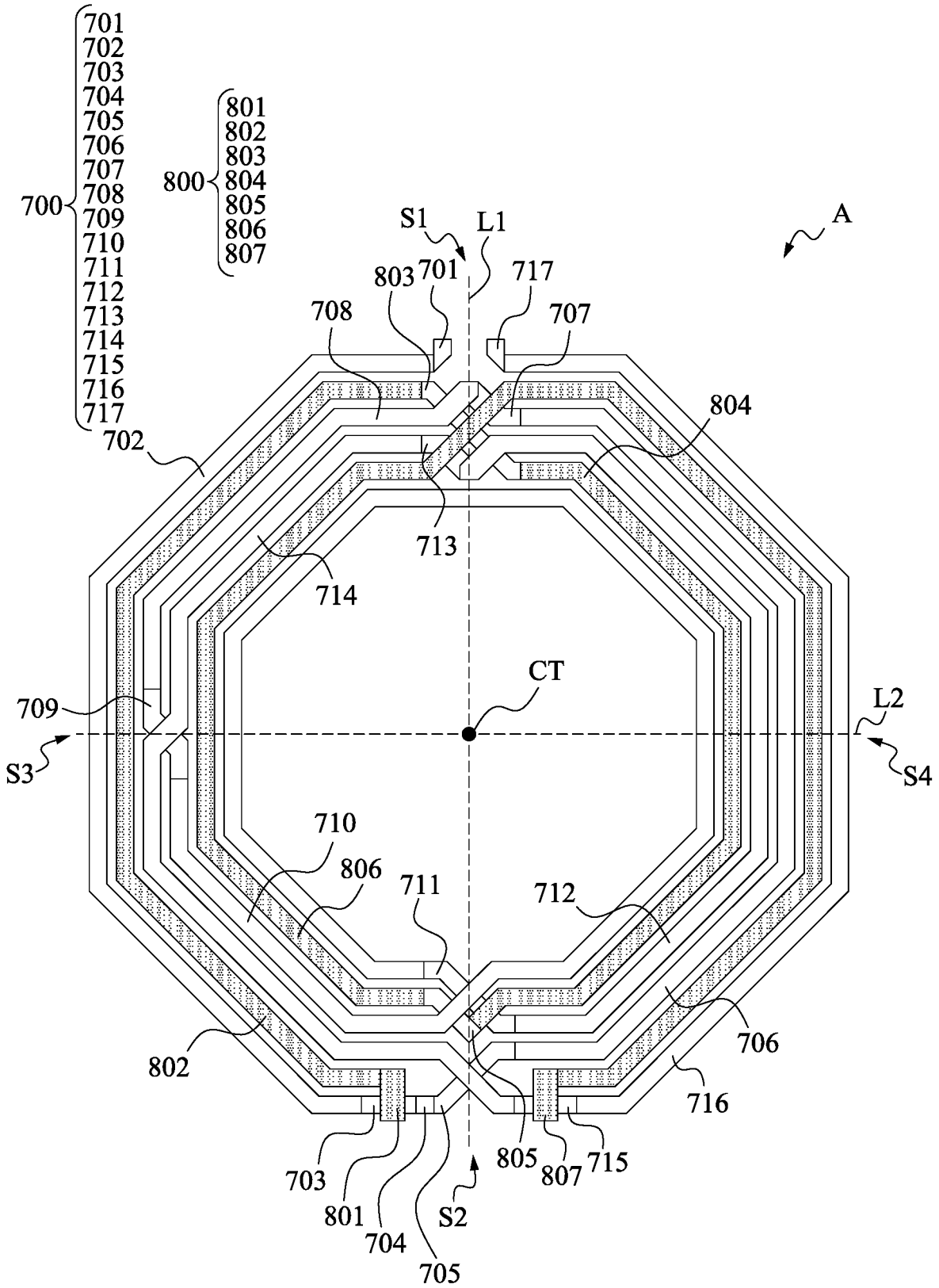
FIG. 4 is a schematic diagram of a transformer structure according to an embodiment of present disclosure.

FIG. 4 is a schematic diagram showing an above view of a transformer structure according to an embodiment of present disclosure. In the embodiment, the transformer structure is disposed in the first area A.

As shown in FIG. 4, in the embodiment, the first area A has six laps, which are first to sixth laps, counted in an outer-inner manner. A first inductor 700 and a second inductor 800 are disposed on the six laps of the first area A in an interlaced manner. The first inductor 700 includes four turns disposed on the first, the third, the fourth and the sixth laps of the first area A. The second inductor 800 includes two turns disposed on the second and the fifth laps of the first area A. Two of the first inductor's turns, which are disposed on the third and the fourth laps of the first area A, are adjacent to another turn of the first inductor 700 and a turn of the second inductor 800. Moreover, in the embodiment, the first inductor 700 and the second inductor 800 are in octagonal instead of rectangular shapes.

In the embodiment, the first inductor 700 includes the first port 701, the metallic segments 702-716 and the second port 717. The metallic segments 703, 705, 707 and 709 are disposed on a first layer. The other metallic segments of the first inductor 700 are disposed on a second layer different from the first layer. In order to bridge the first inductor 700, the metallic segments 703, 705, 707, 709, 711, 713 and 715 as shown in FIG. 4, are connected to the other metallic segments of the first inductor 700 in an interlaced manner. The first port 701 and the second port 717 of the first inductor 700 are disposed on the second layer and at the first side S1 of the first area A. In the embodiment, the second inductor 800 includes the third port 801, the metallic segments 802-806 and the fourth port 807. The metallic segment 803 and the metallic segment 805 are disposed on the first layer. In order to bridge the second inductor 800, the metallic segments 803 and 805, as shown in FIG. 4, connect the other metallic segments of the second inductor 800 in an interlaced manner. Moreover, the third port 801 and the fourth port 807 of the second inductor 800 are disposed at the second side S2 of the first area A.

In the embodiment, both of the first inductor 700 and the second inductor 800 include jump wires similar to the metallic segment 605 in the embodiment of FIG. 3. The jump wires are disposed in available places to connect other metallic segments of the inductors effectively. For instance, as shown in FIG. 4, the metallic segment 707 and the metallic segment 713 of the first inductor 700 are two of the jump wires, and the metallic segment 805 of the second inductor 800 is a jump wire as well. In the embodiment, except the jump wires (e.g. the metallic segments 707, 713, 805, etc.), the other metallic segments of the first inductor 700 and the second inductor 800 are disposed on a same layer of the integrated circuit board.

Figure 5:
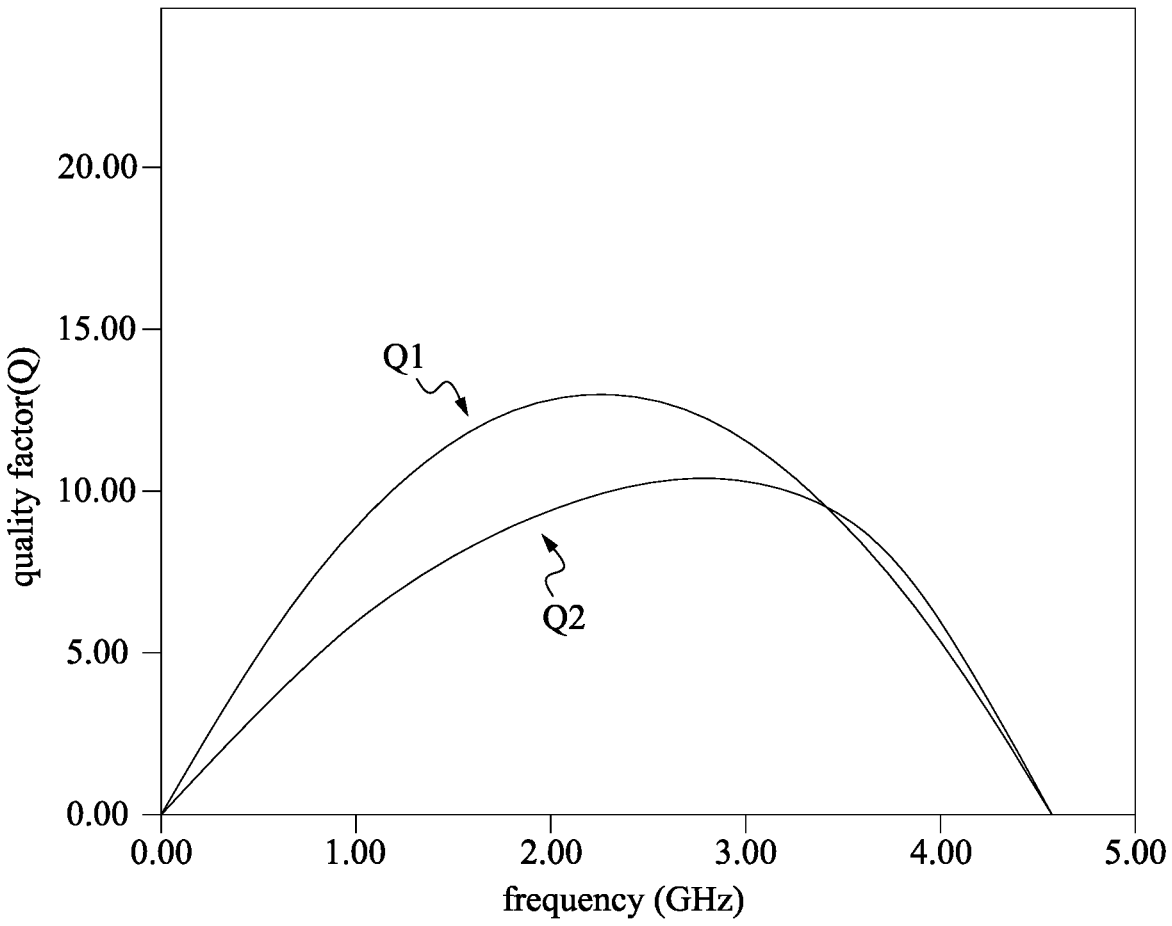
FIG. 5 is a schematic diagram showing an experiment result of the transformer structure according to the embodiment of present disclosure.

FIG. 5 is a schematic diagram showing an experiment result of the transformer structure according to the embodiment of present disclosure. As shown in FIG. 5, the horizontal axis indicates frequencies, and the vertical axis indicates values of Q factors. The curve Q1 illustrates the quality factors obtained from present transformer structure. The curve Q2 illustrates the quality factors obtained from a prior art. Obviously, under most of the frequencies, the curve Q1 is higher than the curve Q2, especially in the interval from 0 GHz-3.5 GHz. As shown in the figure, it is evident that the Q factors measured on the transformer structure are better.

Besides, present transformer structure is highly symmetrical, which reduces the second harmonic waves for over 10 dB against the prior art.

As described above, the arrangements of the two inductors provide high mutual inductance, good mutual coupling coefficient and good quality factors of the transformer structure.

What is claimed is:

1. A transformer structure, comprising:

a first inductor having a plurality of first turns; and a second inductor having a plurality of second turns, wherein the first inductor and the second inductor are disposed on a first layer in an interlaced manner, wherein at least one of the first turns is directly adjacent to another first turn and one of the second turns, wherein the at least one first interlaced structure of the first inductor is disposed across at least two of the second turns, wherein the first inductor and the second inductor are both disposed in a first area, the first area comprises nine laps counted from first to ninth in an outer-inner manner, the first inductor comprises six out of the nine laps, and the second inductor comprises three out of the nine laps, wherein the first turns are disposed on the first, the fourth, the fifth, the seventh, the eighth and the ninth of the nine laps, the fourth, the fifth, and the seventh of the nine laps are directly adjacent to another first turn and one of the second turns respectively, the second turns are disposed on the second, the third and the sixth of the nine laps, and the second and the third of the nine laps are directly adjacent to another second turn and one of the first turns respectively.

2. The transformer structure of claim 1, wherein the first turns of the first inductor are coupled to the at least one first interlaced structure.

3. The transformer structure of claim 2, wherein the at least one first interlaced structure is formed by two metallic segments disposed on the first layer and a second layer respectively.

4. The transformer structure of claim 1, wherein the first inductor and the second inductor are both disposed in a predetermined area having a first side and a second side, the first side is opposite to the second side.

5. The transformer structure of claim 4, wherein the first inductor comprises a first port and a second port, and the second inductor comprises a third port and a fourth port.

6. The transformer structure of claim 5, wherein the first port and the second port are disposed on the first side, and the third port and the fourth port are disposed on the second side.

7. The transformer structure of claim 6, wherein the first port and the second port are disposed on a second layer which is different from the first layer.

8. The transformer structure of claim 1, wherein the first turns are disposed on the first, the fourth, the fifth, the sixth, the seventh and the ninth of the nine laps, the fourth, the fifth, the sixth, the seventh and the ninth of the nine laps are directly adjacent to another first turn and one of the second turns respectively, the second turns are disposed on the second, the third and the eighth of the nine laps, and the second and the third of the nine laps are directly adjacent to another second turn and one of the first turns respectively.

9. The transformer structure of claim 8, wherein the first turns of the first inductor are coupled to five sets of first interlaced structures, and the second turns of the second inductor are coupled by two sets of second interlaced structures.

10. The transformer structure of claim 1, wherein a ratio of the first turns and the second turns is 5:4.

11. The transformer structure of claim 10, wherein the first inductor and the second inductor are both disposed in a first area, the first area comprises nine laps counted from first to ninth in an outer-inner manner, the first turns are disposed on the first, the fourth, the fifth, the eighth and the ninth of the nine laps, the fourth, the fifth and the eighth of the nine laps are directly adjacent to another first turn and one of the second turns respectively, the second turns are disposed on the second, the third, the sixth, and the seventh of the nine laps, and the second, the third, the sixth and the seventh of the nine laps are directly adjacent to another second turn and one of the first turns respectively.

12. The transformer structure of claim 11, wherein the first turns of the first inductor are coupled to four sets of first interlaced structures and one set of jump wires, and the second turns of the second inductor are coupled by three sets of second interlaced structures.

13. The transformer structure of claim 1, wherein a ratio of the first turns and the second turns is 2:1.

14. The transformer structure of claim 13, wherein the first turns of the first inductor are coupled to five sets of first interlaced structures, and the second turns of the second inductor are coupled by two sets of second interlaced structures.

15. The transformer structure of claim 13, wherein the first inductor and the second inductor are both disposed in a first area, the first area comprises six laps counted from first to sixth in an outer-inner manner, the first inductor comprises four out of the six laps, and the second inductor comprises two out of the six laps.

16. The transformer structure of claim 15, wherein the first turns are disposed on the first, the third, the fourth, and the sixth of the six laps, and the third and the fourth of the six laps are directly adjacent to another first turn and one of the second turns respectively.

17. The transformer structure of claim 16, wherein the first turns of the first inductor are coupled to two sets of first interlaced structures and two sets of jump wires, and the second turns of the second inductor are coupled to one set of second interlaced structures and one set of jump wires.

* * * * *